US009416453B2

(12) United States Patent
Lee et al.

(10) Patent No.: US 9,416,453 B2
(45) Date of Patent: Aug. 16, 2016

(54) ELECTROLESS GOLD PLATING LIQUID

(71) Applicant: MK CHEM & TECH, Ansan-Si, Gyeonggi-Do (KR)

(72) Inventors: Tae-Ho Lee, Anyang-Si (KR); Deok-Gon Han, Siheung-Si (KR); Tae-Hyun Sung, Siheung-Si (KR)

(73) Assignee: MK CHEM & TECH, Anyang-Si (KR)

( * ) Notice: Subject to any disclaimer, the term of this patent is extended or adjusted under 35 U.S.C. 154(b) by 16 days.

(21) Appl. No.: 14/578,987

(22) Filed: Dec. 22, 2014

(65) Prior Publication Data

US 2016/0040296 A1 Feb. 11, 2016

(30) Foreign Application Priority Data

Aug. 6, 2014 (KR) ..... 10-2014-0101171

(51) Int. Cl.
*C23C 18/44* (2006.01)

(52) U.S. Cl.
CPC ..... *C23C 18/44* (2013.01)

(58) Field of Classification Search
CPC ..... C23C 18/44
USPC ..... 106/1.23, 1.26
See application file for complete search history.

(56) References Cited

U.S. PATENT DOCUMENTS 4,352,690 A * 10/1982 Dettke ..... C23C 18/44 106/1.23
4,374,876 A * 2/1983 El-Shazly ..... C23C 18/42 106/1.23
4,830,668 A * 5/1989 Wundt ..... C23C 18/44 106/1.23
5,206,055 A * 4/1993 Iacovangelo ..... C23C 18/44 427/304
5,318,621 A * 6/1994 Krulik ..... C23C 18/42 106/1.23
5,364,460 A * 11/1994 Morimoto ..... C23C 18/44 106/1.23
5,470,381 A * 11/1995 Kato ..... C23C 18/44 106/1.23
5,601,637 A 2/1997 Wachi et al.
5,935,306 A 8/1999 Reed
6,336,962 B1 * 1/2002 Backus ..... C23C 18/42 106/1.23
6,383,269 B1 5/2002 Toben et al.
6,855,191 B2 2/2005 Kato et al.
7,022,169 B2 * 4/2006 Iwai ..... C23C 18/44 106/1.23
7,396,394 B2 * 7/2008 Aiba ..... C23C 18/54 106/1.23
2003/0047108 A1 * 3/2003 Hayashi ..... C23C 18/42 106/1.23
2004/0028833 A1 * 2/2004 Takahashi ..... C23C 18/44 106/1.23
2008/0138507 A1 * 6/2008 Kiso ..... C23C 18/44 427/99.5
2012/0156387 A1 * 6/2012 Stark ..... C23C 18/44 106/1.26
2013/0058062 A1 * 3/2013 Tachibana ..... C23C 18/30 361/783

* cited by examiner

*Primary Examiner* — Helene Klemanski
(74) *Attorney, Agent, or Firm* — David S. Resnick; Nixon Peabody LLP

(57) ABSTRACT

The present invention relates to an electroless gold plating liquid, which may form gold plating without corrosion of a base metal by performing substitution and reduction reactions in the same bath, and satisfy both weldability of lead-free soldering and wire bonding characteristics, and has excellent stability such that a gold deposition rate may be continuously maintained.

15 Claims, 6 Drawing Sheets

(A)

(B)

(A) (B)

(A) (B)

(A) (B)

(A) (B)

(A) (B)

(A) (B)

(A) (B)

(A) (B)

(A)

(B)

ELECTROLESS GOLD PLATING LIQUID

CROSS-REFERENCE TO RELATED APPLICATION

This application claims priority to and the benefit of Korean Patent Application No. 2014-101171, filed on Aug. 6, 2014, the disclosure of which is incorporated herein by reference in its entirety.

BACKGROUND

1. Field of the Invention

The present invention relates to an electroless gold plating liquid, and more specifically, to an electroless gold plating liquid which may form a gold plating without corrosion of a base metal by performing substitution and reduction reactions in the same bath, and satisfy both weldability of lead-free soldering and wire bonding characteristics, and has excellent stability such that a gold deposition rate may be continuously maintained.

2. Discussion of Related Art

In order to join components, a printed circuit board is gold plated. The gold plating on the printed circuit board is the final process performed in the manufacturing process in order to prevent oxidation of a pad surface, and because gold plating largely affects mounting properties, soldering properties, etc. of components, it has a large influence on reliability of components.

Recently, as circuits are being more highly integrated and refined, a method of electroplating gold requiring conduction of electricity is being replaced with an electroless gold plating method.

The electroless gold plating method includes a reductive plating method of plating with deposition through autocatalysis by a reductant, and a displacement plating method of substituting gold for a base metal. In the case of the autocatalytic electroless gold plating method using the reductant, the use thereof is limited because a thickness of the gold plating is insufficient, and in the case of the displacement plating method, the use thereof is limited because corrosion is generated in the base metal and a thickness of the gold plating is insufficient. In the case of the autocatalytic electroless gold plating method using the reductant, adhesion force of the plated gold becomes non-uniform, and thus weldability may not be ensured upon lead-free soldering.

Many studies on increasing adhesion force of the plating while suppressing corrosion of the base metal and improving stability of an electroless gold plating liquid have been performed. From studies in search of a proper reductant or in which a metal elution inhibitor was added in the electroless gold plating method, methods using ascorbic acid (Japanese Laid-Open Patent Publication No. 1989-191782), hydrazine compounds (Japanese Laid-Open Patent Publication No. 1991-215677), thiourea (Japanese Laid-Open Patent Publication No. 1997-287077), and phenyl-based compounds (Japanese Patent Publication No. 2972209) as the reductant, and methods using benzotriazole-based (Japanese Laid-Open Patent Publication No. 1992-314871), mercaptobenzothiazole-based (Japanese Laid-Open Patent Publication No. 1992-350172), and hydroquinone-based compounds (Japanese Laid-Open Patent Publication No. 2003-268559) as the metal elution inhibitor were introduced.

Further, U.S. Pat. No. 6,855,191 discloses a method using 2-mercaptobenzothiazole as a stabilizer, U.S. Pat. No. 6,383,269 discloses a method using hydroxylamine compounds as a reductant, U.S. Pat. No. 5,935,306 discloses a method using ascorbic acid or salts thereof as a reductant, and U.S. Pat. No. 5,601,637 discloses a method using sodium nitrobenzene sulfonate and/or para-nitrobenzoic acid as an oxidizer to control a reduction rate.

However, there was a limitation in addressing the problems such as maintenance of the deposition rate, stability of a plating bath, adhesion force of the plating, corrosion of the base metal, or the like, and thus studies on a more stable plating bath, continuous maintenance of the deposition rate, prevention of corrosion of the base metal, and increase of adhesion force have continued, and electroless gold plating methods in which a water-soluble amine compound is further added in addition to a water-soluble gold compound, a complexing agent, and a reductant which form an electroless gold plating were studied and have seen much progress.

The conventional art for this electroless gold plating method adding the water-soluble amine compound is as below.

In Korea Patent Application No. 2003-0045071, an ethylenediamine compound, which is the most effective among the above-described compounds, is used as a kind of water-soluble amine, and hydroquinone, methylhydroquinone, or the like are used as a phenyl-based compound.

In Korea Patent Application No. 2006-0016767, ethylenediamine or glycine is used as a kind of water-soluble amine, and a hydroxy alkyl sulfonic acid or salt is used as a reductant.

In Korea Patent Application No. 2008-0066570, an ethylenediamine derivative is used as a kind of water-soluble amine, and formaldehyde bisulfite is used as a reductant.

In Korea Patent Application No. 2012-0031990, polyethyleneamine is used as a kind of water-soluble amine, and borohydride and a boron compound are used as a reductant.

However, in the above-described conventional art, although using a water-soluble amine compound may slow down a displacement reaction rate, corrosion and pit generated in the base metal were not completely prevented, and weldability of lead-free soldering was not ensured at a lead-free soldering temperature in a range of 250 to 260° C.

Recently, due to prohibitions on the use of Sn/Pb solder, plating methods have been changed to soldering methods using lead-free (Sn/Ag/Cu) solder, soldering temperatures have been raised to a range of 250 to 260° C., thermal loads have increased, and thus the electroless gold plating having reinforced characteristics has been required to overcome the thermal load.

With the use of lead-free (Sn/Ag/Cu) solder, the electroless gold plating method of ENEPIG (electroless nickel/electroless palladium/immersion gold) method is required.

This method is a method of plating electroless palladium between plating of electroless nickel and plating of electroless gold to prevent oxidation and diffusion of nickel, improve corrosion resistance of circuits or terminals, and overcome degradation of bonding characteristics of nickel and gold plating. In the ENEPIG method, a potential difference between palladium and gold is small, and thus uniform gold plating on a palladium-plated surface is hard to obtain using the existing electroless gold plating liquid, and a desired thickness of the gold plating is also hard to obtain.

Further, the gold plating having a thickness of 0.05 μm or more needs to be formed on the palladium plating layer for lead-free (Sn/Ag/Cu) soldering, and the gold plating having a thickness of 0.25 μm or more needs to be formed on the palladium plating layer for wire bonding. When lead-free (Sn/Ag/Cu) soldering and wire bonding are performed at the same time, the gold plating having a thickness of 0.25 μm or more needs to be plated on the palladium plating layer.

When a general displacement plating method or reduction gold plating method is used, corrosion of the base metal may not be prevented, and weldability of lead-free (Sn/Ag/Cu) soldering and wire bonding characteristics are insufficient. At the same time at which a substitution reaction starts, continuation of the substitution reaction should be stopped, the reaction should be converted to a reduction reaction immediately, and a uniform gold plating surface and the gold plating having a sufficient thickness should be obtained. Continuation of the substitution reaction may be stopped by catalyzing palladium separated from the palladium plating through an ionic catalyst and inducing gold plating at the same time at which the substitution reaction starts, and thus an ionic catalyst activator capable of converting palladium to an ionic catalyst material is needed.

SUMMARY OF THE INVENTION

In order to address the above-described problems of the conventional techniques, the present inventors have researched an electroless gold plating liquid which may prevent corrosion of a base metal in ENEPIG method, may obtain a uniform and enough thickness of gold plating on a palladium plating layer, may satisfy both weldability of lead-free (Sn/Au/Cu) solder and wire bonding characteristics, and includes an ionic catalyst activator capable of catalyzing palladium separated from a palladium-plated surface by ion catalysis at the same time at which a substitution reaction starts in the same plating bath. As a result, the present invention was completed.

An objective of the present invention is to provide an electroless gold plating liquid which may prevent irregular corrosion and pit generated in a base metal surface, and provide uniformity of a gold plating surface while maintaining uniformity of the base metal surface.

Another objective of the present invention is to provide an electroless gold plating liquid which may provide complete adhesion between a plating layer of the base metal and a gold plating layer, obtain a sufficient thickness of gold plating, and exhibit adhesive force of lead-free soldering and wire bonding characteristics.

In order to achieve the objectives, according to an aspect of the present invention, there is provided an electroless gold plating liquid including deionized water, a water-soluble gold compound, a complexing agent, a pH buffer, a pH control agent, a reductant, and a palladium ionic catalyst activator, where the palladium ionic catalyst activator is a carboxyl amide compound represented by the following Formula 1:

[Formula 1]

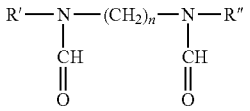

(where R' and R" are $CH_3$, $C_2H_5$, $CH_2OH$, or $C_2H_4OH$, and n is an integer in a range of 2 to 5).

In an embodiment of the present invention, the water-soluble gold compound may include one selected from the group consisting of potassium gold cyanide, sodium gold cyanide, sodium gold sulfite, and ammonium gold sulfite.

In an embodiment of the present invention, the water-soluble gold compound may be contained with gold content of 1 to 2 g/L dissolved in deionized water.

In an embodiment of the present invention, the complexing agent may include one selected from the group consisting of hydroxyethylene diamine triacetate, tetrahydroxy ethylenediamine, dihydroxy methylenediamine diacetate, ethylenediamine tetraacetate (EDTA), ethylenediamine tetra propionic acid, glycerine, iminodiacetate, diethylene triamine pentaacetate (DTPA), N,N-biscarboxymethyl glycine (NTA), hydroxy ethylglycine, glycine, citric acid, malonic acid, oxalic acid, tartaric acid, succinic acid, and alkali metal salts thereof In an embodiment of the present invention, a concentration of the complexing agent may be 5 to 10 times greater than a concentration of gold dissolved in the electroless gold plating liquid.

In an embodiment of the present invention, the pH buffer may include one selected from the group consisting of potassium dihydrogen phosphate, sodium dihydrogen phosphate, potassium tetraborate, sodium tetraborate, and dipotassium hydrogen phosphate.

In an embodiment of the present invention, the pH buffer may be contained in a range of 0.1 to 0.5 mol/L with respect to deionized water.

In an embodiment of the present invention, the pH control agent may include one selected from the group consisting of phosphoric acid, hydrochloric acid, sulfuric acid, sodium hydroxide, and potassium hydroxide.

In an embodiment of the present invention, pH may be adjusted to a range of 6.5 to 7.5 using the pH control agent.

In an embodiment of the present invention, the reductant may include one selected from the group consisting of ascorbic acid, hydroxylamine, hydrazine, dimethylamine borane, thiourea, hydroquinone, formaldehyde, formic acid, and sodium formate.

In an embodiment of the present invention, the reductant may be contained in a range of 0.05 to 2 mol/L with respect to deionized water.

In an embodiment of the present invention, the carboxyl amide compound may be contained in a range of 0.01 to 0.2 mol/L with respect to deionized water.

In an embodiment of the present invention, the carboxyl amide compound may be a carboxyl amide compound represented by the following Formula 2 or Formula 3:

[Formula 2]

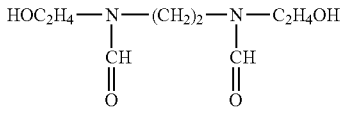

[Formula 3]

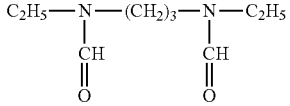

The electroless gold plating liquid according to an embodiment of the present invention may be used in the ENEPIG method.

In an embodiment of the present invention, a thickness of gold plating may be adjusted to a range of 0.01 to 0.5 μm.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
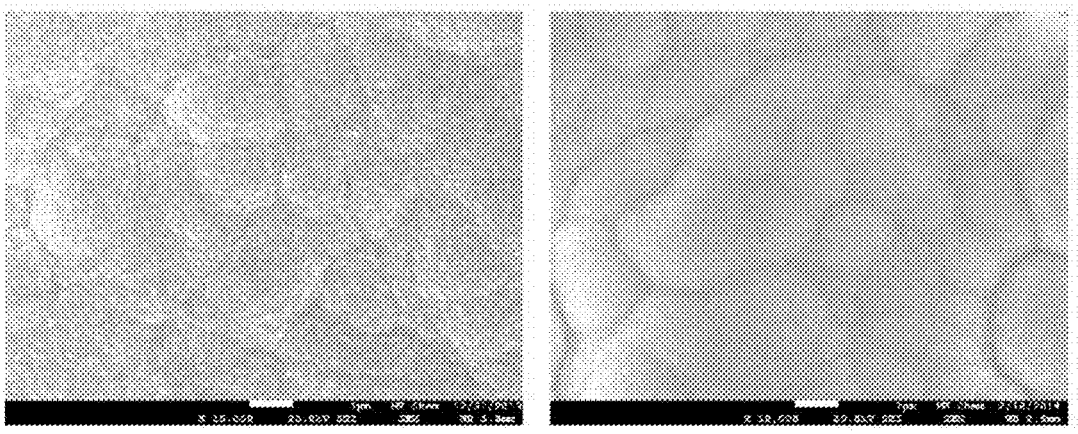
FIG. 1 illustrates SEM images of a gold plating surface (A) after gold plating and a palladium plating layer surface (B) after peeling off the gold plating in Example 1.
Figure 2:
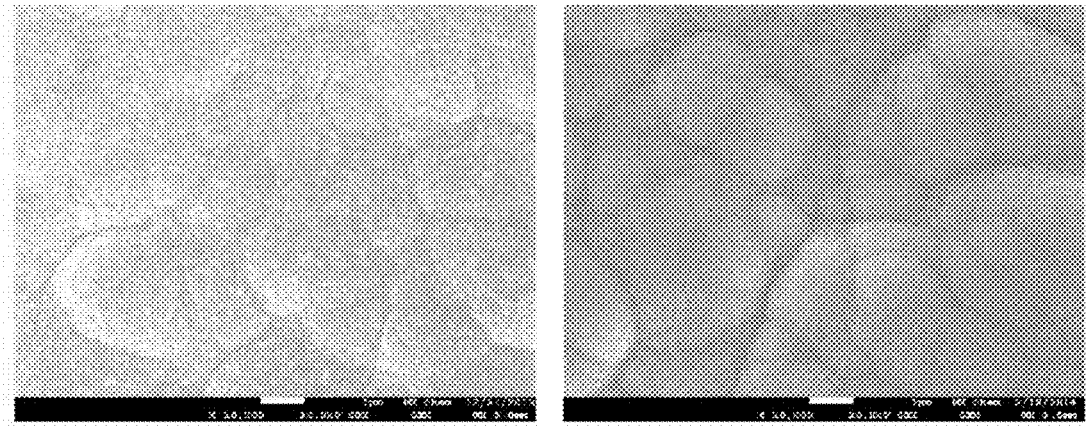
FIG. 2 illustrates SEM images of a gold plating surface (A) after gold plating and a palladium plating layer surface (B) after peeling off the gold plating in Example 2.
Figure 3:
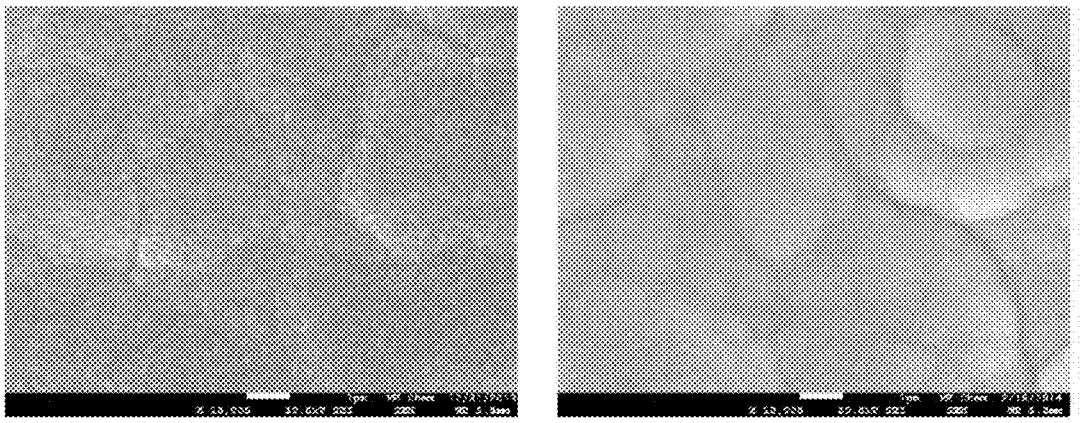
FIG. 3 illustrates SEM images of a gold plating surface (A) after gold plating and a palladium plating layer surface (B) after peeling off the gold plating in Example 3.
Figure 4:
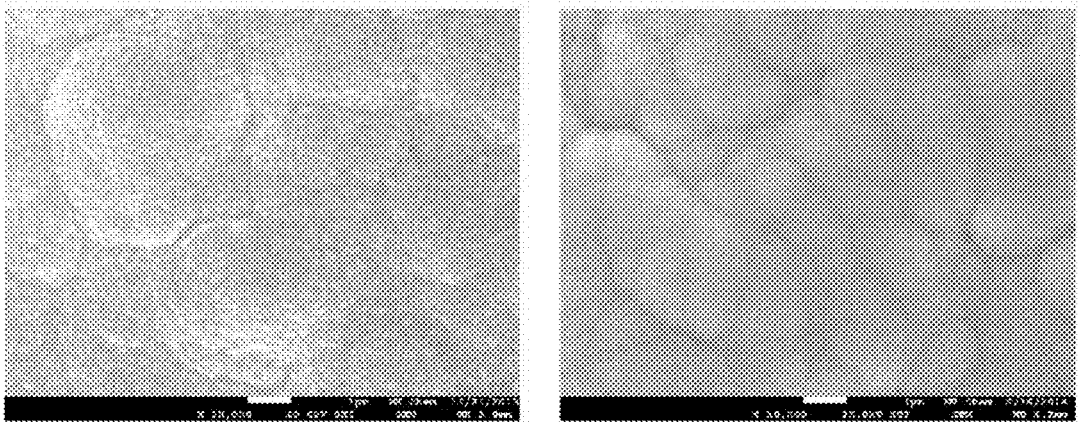
FIG. 4 illustrates SEM images of a gold plating surface (A) after gold plating and a palladium plating layer surface (B) after peeling off the gold plating in Example 4.
Figure 5:
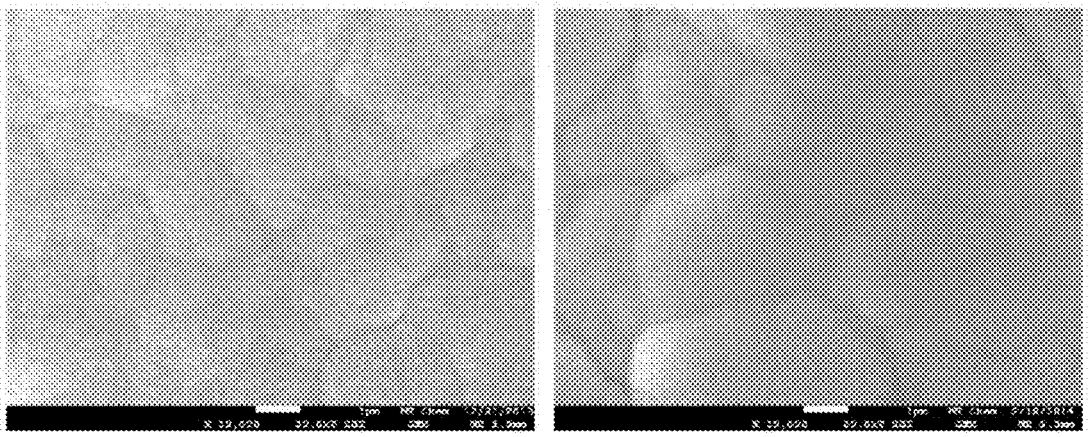
FIG. 5 illustrates SEM images of a gold plating surface (A) after gold plating and a palladium plating layer surface (B) after peeling off the gold plating in Example 5.
Figure 6:
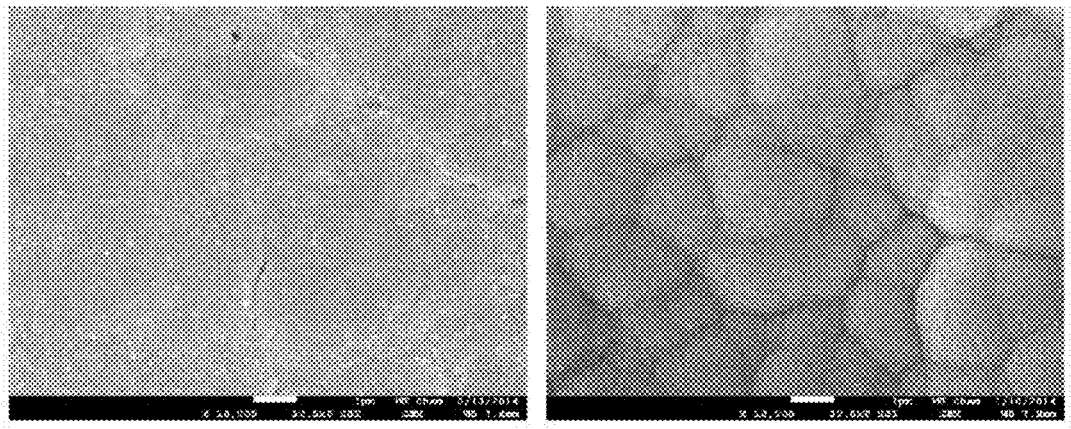
FIG. 6 illustrates SEM images of a gold plating surface (A) after gold plating and a palladium plating layer surface (B) after peeling off the gold plating in Comparative Example 1.
Figure 7:
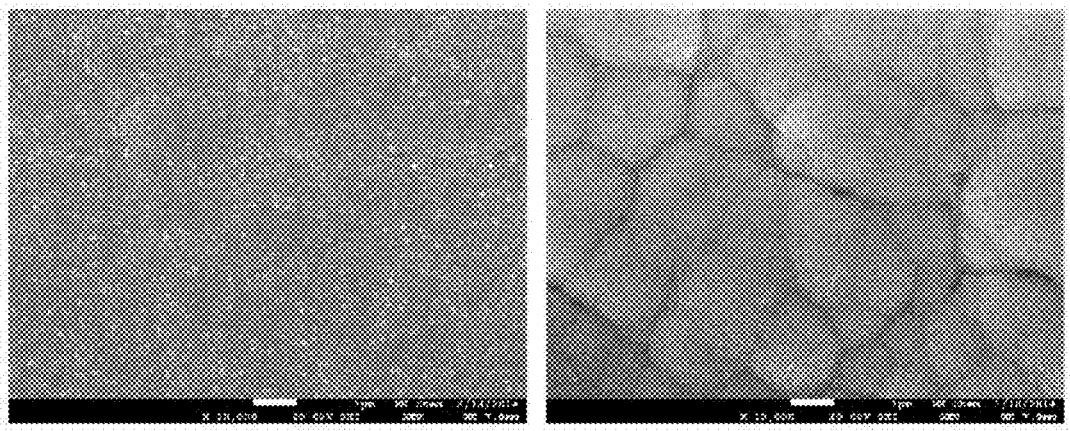
FIG. 7 illustrates SEM images of a gold plating surface (A) after gold plating and a palladium plating layer surface (B) after peeling off the gold plating in Comparative Example 2.
Figure 8:
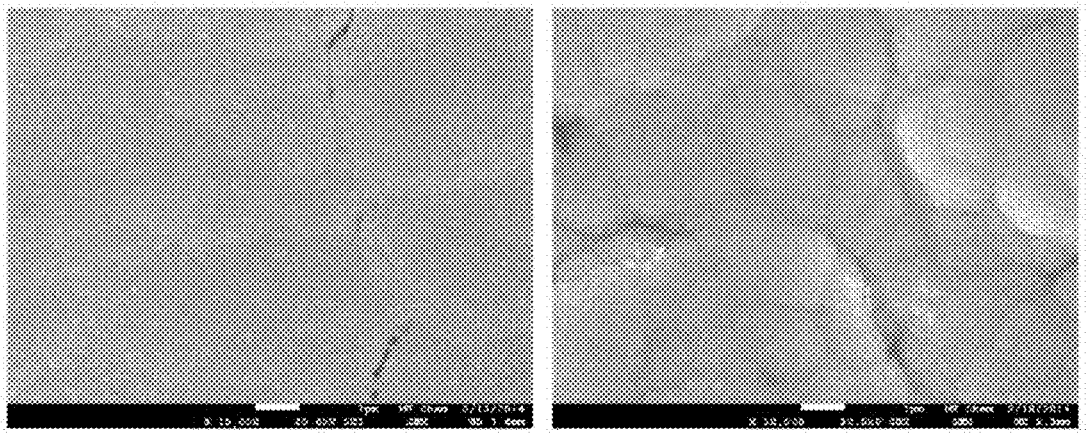
FIG. 8 illustrates SEM images of a gold plating surface (A) after gold plating and a palladium plating layer surface (B) after peeling off the gold plating in Comparative Example 3.

Hereinafter, an electroless gold plating liquid according to an embodiment of the present invention will be described in detail.

There is provided an electroless gold plating liquid according to an embodiment of the present invention, including deionized water, a water-soluble gold compound, a complexing agent, a pH buffer, a pH control agent, a reductant, and a palladium ionic catalyst activator.

In the electroless gold plating liquid according to an embodiment of the present invention, as an ionic catalyst activator which may catalyze palladium separated from a palladium-plated surface by ion catalysis at the same time at which a substitution reaction starts in the ENEPIG (Electroless Nickel/Electroless Palladium/Immersion Gold) method, thereby inducing gold plating and stopping a substitution reaction from continuing, a carboxyl amide compound represented by the following Formula 1 is used:

[Formula 1]

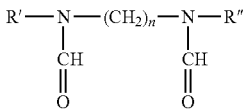

(where R' and R" are $CH_3$, $C_2H_5$, $CH_2OH$, or $C_2H_4OH$, and n is an integer in a range of 2 to 5).

In an embodiment of the present invention, the carboxyl amide compound converts palladium separated from the surface at the beginning of the substitution reaction on a base metal to an ionic catalyst material in the ENEPIG method, forms gold plating on a palladium surface by ion catalysis, and stops the substitution reaction from continuing, thereby preventing corrosion of the base metal.

Further, in an embodiment of the present invention, when gold plating is formed on the palladium-plated surface by the palladium ionic catalyst material generated by the carboxyl amide compound, a reduction reaction is continuously performed by autocatalysis of the formed gold plating. Therefore, irregular corrosion and pit generated in a base metal surface when the substitution reaction continues, due to substitution reaction characteristics, may be prevented, and uniformity of a gold plating surface may be provided while maintaining uniformity of the base metal surface. Accordingly, complete adhesion between a plating layer of the base metal and a gold plating layer may be provided, a thickness of gold plating may be adjusted to a range of 0.01 to 0.5 μm, and thereby adhesive force of lead-free (Sn/Au/Cu) soldering and wire bonding characteristics may be obtained.

In an embodiment of the present invention, the carboxyl amide compound may be a carboxyl amide compound according to the following Formula 2 or Formula 3.

[Formula 2]

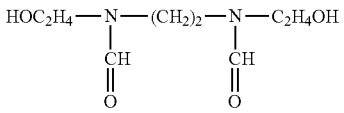

[Formula 3]

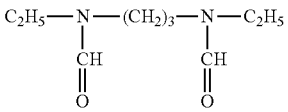

In an embodiment of the present invention, the carboxyl amide compound is preferably contained in a range of 0.01 to 0.2 mol/L with respect to deionized water.

When the carboxyl amide compound is used in less than 0.01 mol/L with respect to an amount of a gold compound used therein, corrosion may be generated in the base metal, and weldability of lead-free soldering and wire bonding characteristics may be decreased.

When the carboxyl amide compound is used in more than 0.2 mol/L with respect to the amount of the gold compound, a decreased plating rate and decreased solution stability may be caused.

The water-soluble gold compound used in an embodiment of the present invention may include one selected from the group consisting of potassium gold cyanide, sodium gold cyanide, sodium gold sulfite, and ammonium gold sulfite.

In an embodiment of the present invention, the water-soluble gold compound is preferably contained with gold content of 1 to 2 g/L dissolved in deionized water.

The complexing agent used in an embodiment of the present invention may include one selected from the group consisting of hydroxyethylene diamine triacetate, tetrahydroxy ethylenediamine, dihydroxy methylenediamine diacetate, ethylenediamine tetraacetate (EDTA), ethylenediamine tetra propionic acid, glycerine, iminodiacetate, diethylene triamine pentaacetate (DTPA), N,N-biscarboxy methylglycine (NTA), hydroxy ethylglycine, glycine, citric acid, malonic acid, oxalic acid, tartaric acid, succinic acid, and alkali metal salts thereof.

In an embodiment of the present invention, the complexing agent serves to prevent discoloration of a gold film by adjusting crystals of gold plated using the electroless gold plating liquid of an embodiment of the present invention.

In an embodiment of the present invention, a concentration of the complexing agent is preferably used to be 5 to 10 times greater than a concentration of gold dissolved in the electroless gold plating liquid.

When the complexing agent is used in a concentration less than the concentration described above, discoloration may be generated on the formed plating surface, and when the complexing agent is used in a concentration more than the concentration described above, stability of the plating liquid may be degraded.

In an embodiment of the present invention, the pH buffer may include, but is not limited to, one selected from the group consisting of potassium dihydrogen phosphate, sodium dihydrogen phosphate, potassium tetraborate, sodium tetraborate, and dipotassium hydrogen phosphate.

In an embodiment of the present invention, the pH buffer is preferably contained in a range of 0.1 to 0.5 mol/L with respect to deionized water.

In an embodiment of the present invention, the pH control agent may include one selected from the group consisting of phosphoric acid, hydrochloric acid, sulfuric acid, sodium hydroxide, and potassium hydroxide.

In an embodiment of the present invention, pH of the electroless gold plating liquid is preferably adjusted to a range of 6.5 to 7.5 using the pH control agent.

When pH of the electroless gold plating liquid is adjusted to be less than 6.5, reliability of solder joining may be decreased due to an increased plating rate, and when pH of the electroless gold plating liquid is adjusted to be more than 7.5, stability of the plating liquid is decreased, thereby causing a problem that decomposition of the plating liquid easily occurs.

In an embodiment of the present invention, the reductant may include one selected from the group consisting of ascorbic acid, hydroxylamine, hydrazine, dimethylamine borane, thiourea, hydroquinone, formaldehyde, formic acid, and sodium formate.

In an embodiment of the present invention, the reductant serves to continuously increase a thickness of gold plating by reducing gold in the plating liquid.

In the electroless gold plating liquid according to an embodiment of the present invention, the reductant is contained in a range of 0.05 to 2 mol/L with respect to deionized water.

When the above-described electroless gold plating liquid according to an embodiment of the present invention is applied, a temperature is preferably in a range of 50 to 90° C., and at a high temperature, a resist may be damaged, and stability of an electroless gold plating bath may be decreased. A temperature in a range of 70 to 80° C. is appropriate for maintaining a gold plating deposition rate and long-term stability of the bath. A reaction time is preferably in a range of 5 to 30 minutes depending on a desired thickness of the gold, and a reaction time in a range of 20 to 30 minutes is appropriate for a thickness of 0.25 μm of plating which is generally required in a printed circuit board (PCB).

Exemplary embodiments of the present invention will be described in detail below with reference to the accompanying drawings. The terms and vocabulary used in the present application and claims should not be interpreted with a general or dictionary meaning, but should be interpreted according to meanings and concepts corresponding to the technical details of the present invention.

The embodiments and drawings shown in the present application are exemplary embodiments and drawings, and do not represent the entire technical spirit of the present invention. Accordingly, it will be apparent to those skilled in the art that various modifications can be made without departing from the spirit and scope of the invention.

EXAMPLE 1

According to component contents and conditions shown in Table 1, 1.5 g/L of potassium gold cyanide (based on gold content), 15 g/L of EDTA-2Na, 10 g/L of potassium dihydrogen phosphate, 1 g/L of hydrazine hydrate, and 10 g/L of a carboxyl amide compound of Formula 2 were added to deionized water to prepare an electroless gold plating liquid according to an embodiment of the present invention. The pH of the electroless gold plating liquid was adjusted to 7.2 by adding potassium hydroxide, and a test substrate was plated with the electroless gold plating liquid in a bath having a temperature of 80° C. for 20 minutes.

* Test Substrate Used

Figure 9:
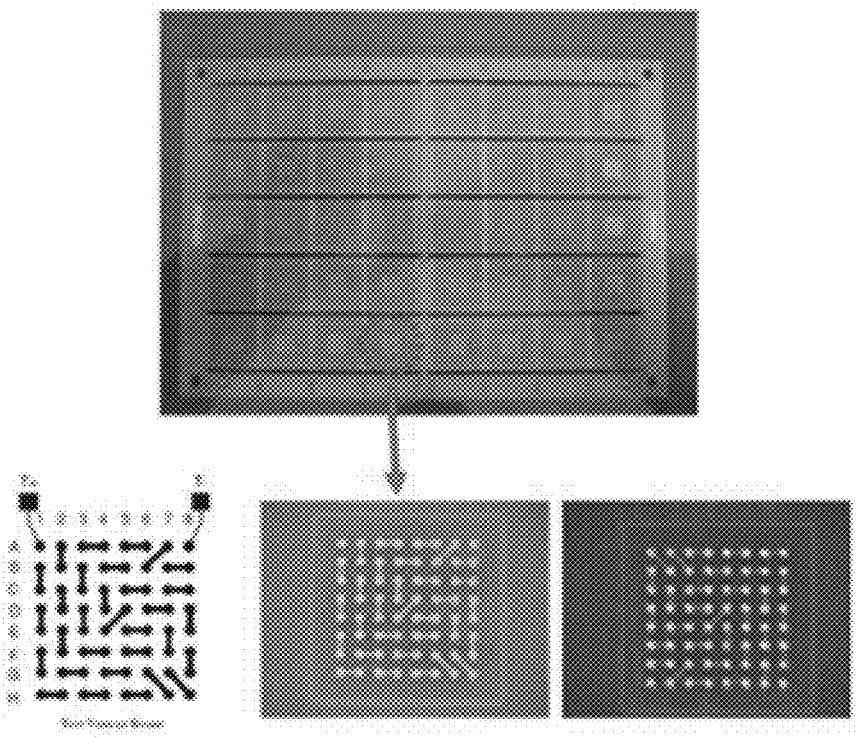
FIG. 9 illustrates images of a test substrate (A) for evaluating soldering and a test substrate (B) for evaluating wire bonding used in examples of the present invention.
Figure 9:
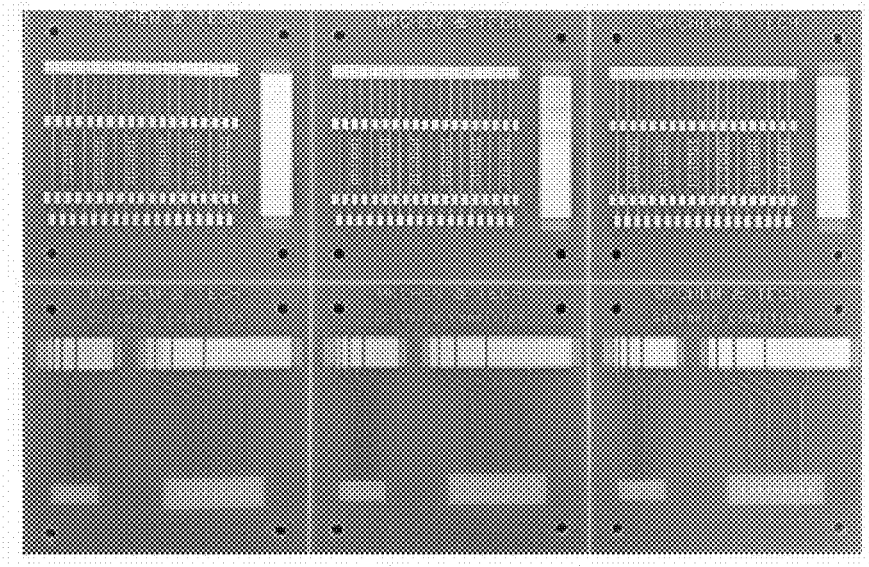

A PCB substrate used in an embodiment of the present invention was a solder mask defined (SMD)-type FR-4 substrate having a thickness of 1 mm. A size of a pad opening formed on the substrate was 400 μm, a pitch size was 800 μm, and the substrate was formed as shown in FIG. 9. The manufactured board was configured in a daisy chain, designed such that all devices were electrically connected, and soldering evaluation was performed.

Further, as shown in FIG. 9, a substrate in which a galvanic reaction could occur was designed by connecting a wide surface pad to a narrow surface pad through circuits, and then evaluations of plating rate, plating appearance, plating adhesion, and wire bonding were performed.

EXAMPLE 2

According to component contents and conditions shown in Table 1, a specimen was plated in a same manner as in Example 1 except that the pH was adjusted to 7.0, and electroless plating was performed at 80° C. for 30 minutes.

EXAMPLE 3

According to component contents and conditions shown in Table 1, 2.0 g/L of potassium gold cyanide (based on gold content), 10 g/L of EDTA-2Na, 10 g/L of potassium dihydrogen phosphate, 1 g/L of dimethylamine borane, and 15 g/L of the carboxyl amide compound of Formula 3 were added to deionized water to prepare the electroless gold plating liquid. The pH of the electroless gold plating liquid was adjusted to 7.0, and the test substrate was plated with the electroless gold plating liquid at 80° C. for 20 minutes.

EXAMPLE 4

According to component contents and conditions shown in Table 1, 2.0 g/L of potassium gold cyanide (based on gold content), 10 g/L of EDTA-2Na, 10 g/L of sodium citrate, 10 g/L of potassium dihydrogen phosphate, 1 g/L of dimethylamine borane, and 15 g/L of the carboxyl amide compound of Formula 3 were added to deionized water to prepare the electroless gold plating liquid. The pH of the electroless gold plating liquid was adjusted to 7.1, and plating was performed at 80° C. for 35 minutes.

EXAMPLE 5

According to component contents and conditions shown in Table 1, 2.0 g/L of potassium gold cyanide (based on gold content), 10 g/L of EDTA-2Na, 10 g/L of sodium citrate, 10 g/L of potassium dihydrogen phosphate, 1 g/L of formaldehyde, and 15 g/L of the carboxyl amide compound of Formula 3 were added to deionized water to prepare the electroless gold plating liquid. The pH of the electroless gold plating liquid was adjusted to 7.2, and plating was performed at 80° C. for 30 minutes.

COMPARATIVE EXAMPLE 1

According to the component contents and conditions shown in Table 1, the electroless gold plating liquid was prepared by adding 2 g/L of potassium gold cyanide (based on gold content), 10 g/L of EDTA-2Na, 15 g/L of potassium dihydrogen phosphate, 10 g/L of ethylene diamine, and 1 g/L of formaldehyde to deionized water without using the carboxyl amide compound. The pH of the electroless gold plating liquid was adjusted to 7.0, and plating was performed at 85° C. for 30 minutes.

COMPARATIVE EXAMPLE 2

According to the component contents and conditions shown in Table 1, the electroless gold plating liquid was prepared by adding 2 g/L of potassium gold cyanide (based on gold content), 15 g/L of EDTA-2Na, 10 g/L of sodium citrate, 15 g/L of potassium dihydrogen phosphate, 15 g/L of ethylenediamine, and 2 g/L of formaldehyde to deionized water without using the carboxyl amide compound. The pH of the electroless gold plating liquid was adjusted to 7.0, and plating was performed at 85° C. for 30 minutes.

COMPARATIVE EXAMPLE 3

According to the component contents and conditions shown in Table 1, the electroless gold plating liquid was prepared by adding 2 g/L of potassium gold cyanide (based on gold content), 10 g/L of EDTA-2Na, 15 g/L of potassium dihydrogen phosphate, and 2 g/L of formaldehyde to deionized water without using the carboxyl amide compound. The pH of the electroless gold plating liquid was adjusted to 7.1, and plating was performed at 85° C. for 30 minutes.

TEST EXAMPLE 1

Measurement Evaluation of Physical Properties of Plating Prepared in Examples 1 to 5 and Comparative Examples 1 to 3

* Physical Properties Measurement Method

1) A thickness of gold plating: measured using a fluorescent X-ray measurement apparatus (SFT-9550; Seiko Instruments Nanotechnology Inc. (SII NanoTechnology Inc.) Ltd.), and shown in Table 2.

2) A corrosion condition and pit of a base metal: after the electroless gold plating was peeled off, the plating was observed at a magnification of 10,000 times using a SEM, and thereby a corrosion level of the base metal surface and pit generated in the base metal surface were determined and are shown in Table 2. SEM images of a gold plating surface after gold plating and a palladium plating layer surface after peeling off the gold plating in Examples 1 to 5 and Comparative Examples 1 to 3 are shown in FIG. 1.

3) Plating adhesion: a peel test was performed with tape, whether or not the base metal and gold plating were separated and adhered to tape was determined, and the result is shown in Table 2.

Figure 10:
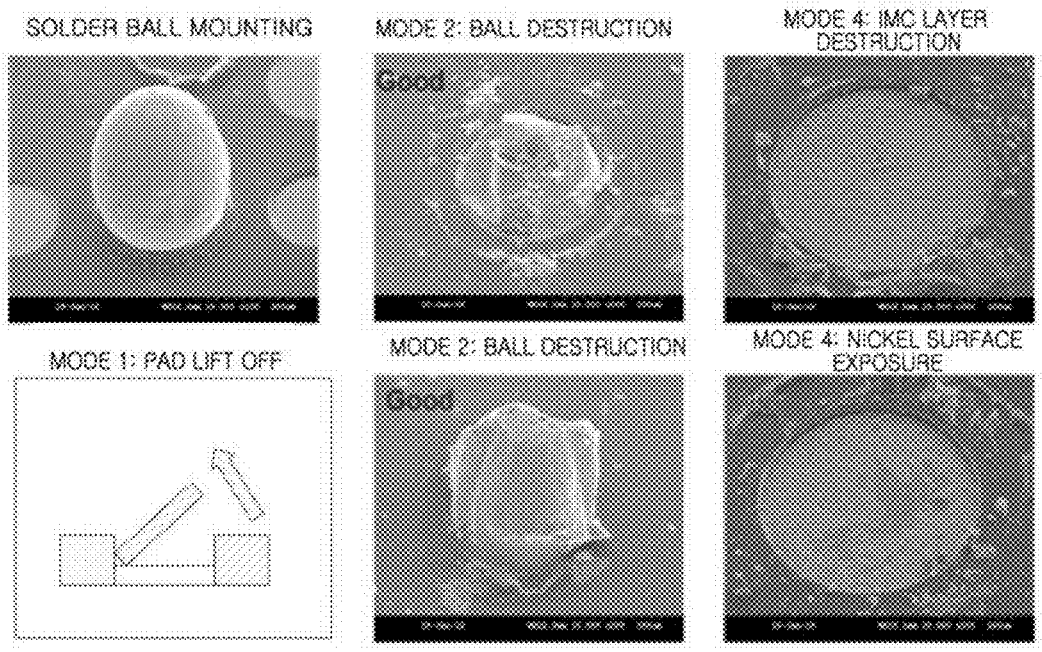
FIG. 10 is a view illustrating a good mode and a defective mode shown in a lead-free soldering weldability test process in Test Example 1 of the present invention.

4) Weldability test of lead-free soldering: a test for pull strength and a defective mode of a solder ball was performed using a DAGE 4000 device. A pull speed was set to 5,000 μm/sec, strength of a specimen after plating was measured, when a material of a lower end of the pad was detached or the solder ball was destroyed as shown in FIG. 10, it was defined as a good mode, and when an IMC layer was destroyed or an interface of the plating was exposed, it was defined as a defective mode. The test was performed a total of 30 times to obtain an average value, and the result thereof is shown in Table 2.

[Measurement Condition]

Measurement method: ball pull test, solder ball: alpha-metal 0.45ϕSAC305 (Sn-3.OAg-0.5Cu), reflow: multi-reflow (BTU International, Inc., VIP-70), reflow condition: Top 260° C.

5) Wire bonding test: performed using a DAGE 4000 device to evaluate bond strength and a failure mode of wire bonding.

Figure 11:
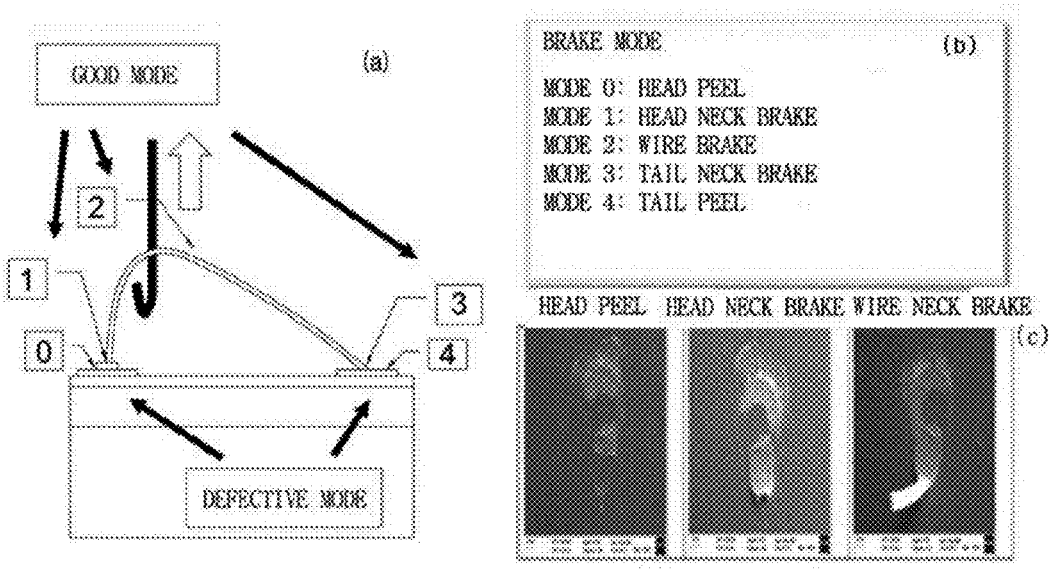
FIG. 11 is a view illustrating 5 brake modes shown in a wire bonding test in Test Example 1 of the present invention.

The pull speed was set to 1,000 μm/sec, and a brake mode of the wire was divided into 5 steps as shown in FIG. 11. Bond

TABLE 1

| | | Example | | | | | Comparative Example | | |
|---|---|---|---|---|---|---|---|---|---|
| | Classification | 1 | 2 | 3 | 4 | 5 | 1 | 2 | 3 |
| Electroless gold plating liquid | Potassium gold cyanide (g/L) | 1.5 | 1.5 | 2.0 | 2.0 | 2.0 | 2.0 | 2.0 | 2.0 |
| | EDTA-2Na (g/L) | 15 | 15 | 10 | 10 | 10 | 10 | 15 | 10 |
| | Sodium citrate (g/L) | — | — | — | 10 | 10 | — | 10 | — |
| | Potassium dihydrogen phosphate (g/L) | 10 | 10 | 10 | 10 | 10 | 15 | 15 | 15 |
| | Ethylene diamine (g/L) | — | — | — | — | — | 10 | 15 | — |
| | Hydrazine hydrate (g/L) | 1 | 1 | — | — | — | — | — | — |
| | Dimethylamine borane (g/L) | — | — | 1 | 1 | — | — | — | — |
| | Formaldehyde (g/L) | — | — | — | — | 1 | 1 | 2 | 2 |
| | Carboxyl amide compound of Formula 2 (g/L) | 10 | 10 | — | — | — | — | — | — |
| | Carboxyl amide compound of Formula 3 (g/L) | — | — | 15 | 15 | 15 | — | — | — |
| Conditions | pH | 7.2 | 7.0 | 7.0 | 7.1 | 7.2 | 7.0 | 7.0 | 7.1 |
| | Temperature (° C.) | 80 | 80 | 80 | 80 | 80 | 85 | 85 | 85 |
| | Time (min) | 20 | 30 | 20 | 35 | 30 | 30 | 30 | 30 |

strength was obtained from a value of average strength after pull tests of 30 specimens, a break point of the wire was determined and evaluated by dividing into a good mode and a defective mode in which the interface of the plating was destroyed.

[Measurement Condition]

Wire bonding apparatus: Kulicke & Soffa Industries, Inc., W-4626, wire: 1 mil-Au, stage temperature: 165° C.

TABLE 2

| | Classification | Example 1 | Example 2 | Example 3 | Example 4 | Example 5 | Comparative Example 1 | Comparative Example 2 | Comparative Example 3 |
|---|---|---|---|---|---|---|---|---|---|
| Measurement result of physical properties | Thickness of gold plating (μm) | 0.25 | 0.32 | 0.25 | 0.35 | 0.27 | 0.08 | 0.1 | 0.05 |
| | Gold plating appearance | Good | Good | Good | Good | Good | Good | Good | Good |
| | Pit | None | None | None | None | None | Formed | Formed | Formed |
| | Base metal corrosion | None | None | None | None | None | Formed | Formed | Formed |
| | Plating adhesion | Good | Good | Good | Good | Good | Part | Part | Part |
| | Welding strength | 820 | 790 | 780 | 820 | 790 | 720 | 730 | 680 |
| | Wire bonding strength | 12.2 | 13.5 | 10.1 | 10.5 | 9.4 | 8.5 | 7.8 | 6.5 |

In Examples 1, 2, 3, 4 and 5, when the carboxyl amide compound was used as a palladium ionic catalyst activator material, the result in which the specimen had no corrosion in the base metal, and exhibit excellent weldability of solder and wire bonding characteristics, while having the gold plating with a thickness of 0.25 μm or more, was obtained.

In Comparative Examples 1 and 2, ethylenediamine was used instead of the carboxyl amide compound, and the result, in which corrosion occurred in the base metal, a thickness of the gold plating was insufficient, and weldability of solder and wire bonding characteristics were also insufficient, was obtained.

The electroless gold plating liquid according to an embodiment of the present invention may obtain uniformity of a gold plating surface and a desired thickness of plating without irregular corrosion and pit generated in a base metal surface by performing substitution and reduction reactions in the same bath in the ENEPIG method, and satisfy both weldability of lead-free (Sn/Au/Cu) soldering and wire bonding characteristics, and has excellent stability such that a gold deposition rate may be continuously maintained.

Further, the electroless gold plating liquid according to an embodiment of the present invention may provide complete adhesion between a plating layer of the base metal and a gold plating layer, and adjust a thickness of gold plating to a range of 0.01 to 0.5 μm.

The above description is merely an exemplary description of the technical spirit of the present invention, and it will be apparent to those skilled in the art that various modifications can be made to the above-described exemplary embodiments of the present invention without departing from the spirit or scope of the invention. Thus, embodiments which are disclosed in the present invention are intended to describe and not limit the present invention, and the scope of the technical spirit of the present invention is not limited to the embodiments. It is intended that the present invention cover all such modifications provided they come within the scope of the appended claims and their equivalents.

What is claimed is:

1. An electroless gold plating liquid comprising:

deionized water;

a water-soluble gold compound;

a complexing agent;

a pH buffer;

a pH control agent;

a reductant; and a palladium ionic catalyst activator, wherein the palladium ionic catalyst activator is a carboxyl amide compound represented by the following Formula 1:

[Formula 1]

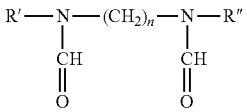

where R' and R" are $CH_3$, $C_2H_5$, $CH_2OH$, or $C_2H_4OH$, and n is an integer in a range of 2 to 5.

2. The electroless gold plating liquid of claim 1, wherein the water-soluble gold compound is selected from the group consisting of potassium gold cyanide, sodium gold cyanide, sodium gold sulfite, and ammonium gold sulfite.

3. The electroless gold plating liquid of claim 1, wherein the water-soluble gold compound is contained with gold content in a range of 1 to 2 g/L dissolved in deionized water.

4. The electroless gold plating liquid of claim 1, wherein the complexing agent is selected from the group consisting of hydroxyethylene diamine triacetate, tetrahydroxy ethylenediamine, dihydroxy methylenediamine diacetate, ethylenediamine tetraacetate (EDTA), ethylenediamine tetra propionic acid, glycerine, iminodiacetate, diethylene triamine pentaacetate (DTPA), N,N-biscarboxymethyl glycine (NTA), hydroxyethylglycine, glycine, citric acid, malonic acid, oxalic acid, tartaric acid, succinic acid, and alkali metal salts thereof.

5. The electroless gold plating liquid of claim 1, wherein a concentration of the complexing agent is 5 to 10 times greater than a concentration of gold dissolved in the electroless gold plating liquid.

6. The electroless gold plating liquid of claim 1, wherein the pH buffer is selected from the group consisting of potassium dihydrogen phosphate, sodium dihydrogen phosphate, potassium tetraborate, sodium tetraborate, and dipotassium hydrogen phosphate.

7. The electroless gold plating liquid of claim 1, wherein the pH buffer is contained in a range of 0.1 to 0.5 mol/L with respect to deionized water.

8. The electroless gold plating liquid of claim 1, wherein the pH control agent is selected from the group consisting of phosphoric acid, hydrochloric acid, sulfuric acid, sodium hydroxide, and potassium hydroxide.

9. The electroless gold plating liquid of claim 1, wherein pH is adjusted to a range of 6.5 to 7.5 utilizing the pH control agent.

10. The electroless gold plating liquid of claim 1, wherein the reductant is selected from the group consisting of ascorbic acid, hydroxylamine, hydrazine, dimethylamine borane, thiourea, hydroquinone, formaldehyde, formic acid, and sodium formate.

11. The electroless gold plating liquid of claim 1, wherein the reductant is contained in a range of 0.05 to 2 mol/L with respect to deionized water.

12. The electroless gold plating liquid of claim 1, wherein the carboxyl amide compound is contained in a range of 0.01 to 0.2 mol/L with respect to deionized water.

13. The electroless gold plating liquid of claim 1, wherein the carboxyl amide compound is a carboxyl amide compound represented by the following Formula 2 or Formula 3:

[Formula 2]

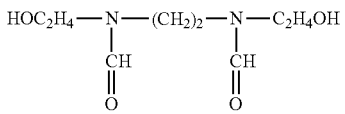

[Formula 3]

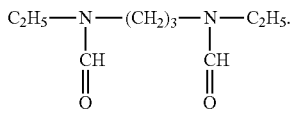

14. The electroless gold plating liquid of claim 1, wherein the electroless gold plating liquid is utilized in an electroless nickel/electroless palladium/immersion gold method.

15. The electroless gold plating liquid of claim 1, wherein a thickness of gold plating is adjusted to a range of 0.01 to 0.5 μm.

* * * * *